United States Patent [19]

Thioulouse

[11] Patent Number: 5,053,679

[45] Date of Patent: Oct. 1, 1991

[54] PHOTOCONDUCTIVE-ELECTROLUMINESCENT MEMORY EFFECT POLYCHROMATIC DISPLAY

[75] Inventor: Pascal Thioulouse, Paris, France

[73] Assignee: Centre National d'Etudes des Telecommunications, Issy les Moulineaux, France

[21] Appl. No.: 484,047

[22] Filed: Feb. 23, 1990

[30] Foreign Application Priority Data

Mar. 21, 1989 [FR] France ..... 89 03681

[51] Int. Cl.[5] ..... H01J 1/62

[52] U.S. Cl. ..... 315/169.3; 313/506; 313/507; 313/512

[58] Field of Search ..... 315/169.3; 313/501, 313/506, 507, 512, 484, 582, 583; 340/781, 760, 716, 794

[56] References Cited

U.S. PATENT DOCUMENTS

| | | | |
|---|---|---|---|
| 3,358,185 | 12/1967 | Lally | 313/507 |
| 4,396,864 | 8/1983 | Suntola et al. | 313/506 |
| 4,553,143 | 11/1985 | Lustig | 340/719 |
| 4,689,522 | 8/1987 | Robertson | 313/506 |
| 4,719,385 | 1/1988 | Barrow et al. | 313/506 |
| 4,829,213 | 5/1989 | Pecile et al. | 313/512 |
| 4,877,995 | 10/1989 | Thioulouse et al. | 315/169.3 |
| 4,945,009 | 7/1990 | Taguchi et al. | 313/506 |
| 4,954,746 | 9/1990 | Taniguchi et al. | 313/506 |

FOREIGN PATENT DOCUMENTS

| | | |
|---|---|---|
| 0259213 | 9/1988 | European Pat. Off. . |
| 0306296 | 3/1989 | European Pat. Off. . |

*Primary Examiner*—Eugene R. LaRoche
*Assistant Examiner*—Tan Dinh
*Attorney, Agent, or Firm*—Hayes, Soloway, Hennessey & Hage

[57] ABSTRACT

A photoconductive-electroluminescent, memory effect polychromatic display defining a first and second inverted structure. The first structure incorporates a first transparent substrate equipped with a first electroluminescent layer $El_1$ placed between a first and a second electrode system, which are connected to a first electrical source for exciting certain zones of layer $El_1$. The second inverted structure incorporates a second substrate equipped with a second electroluminescent layer $El_2$ and a photoconductive layer stacked on one another. These two layers are inserted between a third and a fourth electrode system which are connected to a second electrical source for exciting certain zones of the layer $El_2$. The electroluminescent layer $El_1$ has a monochromatic or dichromatic emission spectrum and the electroluminescent layer $El_2$ has a monochromatic emission spectrum essentially complementary to layer $El_1$.

19 Claims, 6 Drawing Sheets

PHOTOCONDUCTIVE-ELECTROLUMINESCENT MEMORY EFFECT POLYCHROMATIC DISPLAY

BACKGROUND OF THE INVENTION

1. Field of the Invention

The present invention relates to a memory effect electroluminescent polychromatic display of the flat screen type usable in the optoelectronics field for the color display of complex images or pictures or for the color display of alphanumeric characters.

2. Brief Description of the Prior Art

It is said that a display has a memory effect if its electrooptical characteristic (luminance - voltage curve) has a hysteresis. For the same voltage within the hysteresis loop, the display can consequently have two stable states, i.e. extinguished/off or illuminated/on.

A memory effect display has significant advantages. In order to display a fixed image, it is sufficient to simultaneously and continuously apply a so-called maintenance voltage to the complete screen. The latter can be a sinusoidal signal or can be in square wave form and in particular the shape and frequency of the maintenance signal can be chosen independently of the complexity of the screen and in particular the number of display points. Thus, in principle, there is no limit to the complexity of a memory effect display screen. Thus, bistable plasma screens with alternative excitation are commercially available having 1200×1200 image points or pixels.

In addition, the technology of displays using thin film electroluminescence and capacitive coupling has now reached the final development stage. These displays can be given a so-called inherent memory effect, but this leads to a significant deterioration of the electrooptical performance characteristics. A more attractive method consists of connecting a photoconductive structure (PC) in series with an electroluminescent structure (EL), wherein the structures are optically coupled to one another.

This makes it possible to produce an extrinsic memory effect, which is called the PC-EL memory effect and is based on the following principle. When the display is in the off state, the photoconductive material is not very conductive and retains a significant part of the voltage applied. By increasing V to a value Von, a voltage applied at the terminals of the electroluminescent structure which exceeds the electroluminescence threshold, the PC-EL means switches into its on state. The photoconductive material is then illuminated by and electroluminescent structure and passes into the conductive state. The voltage at its terminals drops and this leads to an increase in the voltage available for the electroluminescent structure. In order to extinguish a PC-EL means, it is merely necessary to reduce the total voltage V to a value Voff below Von, so that a luminance - voltage characteristic having a hysteresis is obtained.

A monochromatic PC-EL structure was recently described in FR-A-2 574 972 and in the Article by the present inventor entitled "Monolithic Thin-Film Photoconductor-ACEL Structure with Extrinsic Memory by Optical Coupling" and published in IEEE Transactions on Electron Devices, vol. ED-33, no. 8, August 1986, pp. 1149–1153.

This structure is diagrammatically shown in section in FIG. 1. It comprises a glass substrate 10 on which are deposited an electrode 12, a first dielectric layer 14, an electroluminescent layer 16, a second dielectric layer 18, a photoconductive layer 20, a third dielectric layer 21 and finally an electrode 22. Electrodes 12 and 22 are connected to an a.c. voltage source 24. In this case the PC and El layers are thin films with a thickness of approximately 1 micrometer.

Such a structure can be simply produced, because it does not require supplementary etching stages. Moreover, the current - voltage behavior of the thin film photoconductor in the dark is highly non-linear and reproducible. The beneficial consequences are that the electrical illumination of the means is always easy, the hysteresis is only slightly dependent on the exciting frequency and the reproducibility of the hysteresis margin between the individual production runs is ensured.

Unfortunately this electroluminescent structure only permits a monochromatic display and at present there are no polychromatic displays using the PC-EL effect.

Thus, the known polychromatic display electroluminescent devices are of two types. The first solution which has been intensively researched in order to obtain polychromatic screens consists of developing an electroluminescent phosphor with an emission spectrum covering at least the red, green and blue and called a "white." phosphor, which is combined with an array of colored filters in order to produce red, green or blue emission pixels in an identical manner to liquid crystal polychromatic screens. This solution is more particularly described in the Article by C. Brunel and N. Duruy, Opto, no. 43, March/April 1988, pp. 30–35, "Colour in Flat Electroluminescent Screens". However, the luminance obtained with such polychromatic screens is well below the levels required for applications, due to the inadequate performance characteristics of the white phosphors.

The second solution is described in the aforementioned Article by Brunel and Duruy and in the Article by Christopher N. King et al, "Full-color 320×240 TFEL display panel", pp. 14–17, Eurodisplay, London, Sept. 15–17, 1987. It is diagrammatically shown in section in FIG. 2.

This solution consists of using a first structure incorporating a transparent substrate 30 equipped with an electroluminescent layer 32, which is rendered transparent or semitransparent by an appropriate choice of rear electrodes 34, the front electrodes 36 being transparent. With this first structure is inserted a second, so-called "inverted" structure having a transparent substrate 38 equipped with an electroluminescent layer 40 and transparent electrodes 42 and 44. The first structure has a monochromatic or dichromatic emission spectrum and the second structure a monochromatic emission spectrum complementary of the spectrum of the first structure. This gives a dichromatic or trichromatic display.

The dichromatic structure is obtained by the juxtapositioning of two monochromatic electroluminescent materials emitting different, etched colors (e.g. red and green).

The two structures are controlled separately, but simultaneously in the manner described in SID 86 Digest, pp. 25–28, Article entitled "Multicolor TFEL Display and Exerciser", by W. A. Barrow et al. In this display, the luminance is much too weak for the envisaged application and the voltages and currents used are relatively high.

Moreover, the use of a PC-EL monochromatic display under intense ambient illumination can lead to a significant deterioration of the PC-EL hysteresis. Thus, illumination by an intense external source of the photoconductive layer can lead to reduction in the voltage at the terminals of the latter and consequently to a reduction of the starting voltage. In practice, this leads to the accidental lighting up of certain normally extinguished pixels.

Thus, the invention relates to a memory effect electroluminescent polychromatic display making it possible to obviate these disadvantages.

SUMMARY OF THE INVENTION

The present invention therefore relates to a polychromatic display comprising a first structure having a first transparent substrate equipped with a first electroluminescent layer placed between a first system of transparent electrodes and a second system of electrodes, connected to electrical means permitting the excitation of certain zones of the first electroluminescent layer, characterized in that it also comprises a second structure having a second substrate equipped with a second electroluminescent layer and a photoconductive layer stacked on one another and covering the entire display surface, said two layers being placed between a third system of transparent electrodes and a fourth system of transparent electrodes, connected to electrical means permitting the excitation of certain zones of the second electroluminescent layer, the first and second substrates constituting the opposite faces of the display and in that the first electroluminescent layer has a monochromatic or dichromatic emission spectrum and the second electroluminescent layer has an essentially monochromatic emission spectrum and a chromatic component complementary of the emission color or colors of the first electroluminescent layer.

The use of a second dichromatic structure permits a trichromatic display. The term dichromatic structure is understood to mean a structure having two different monochromatic electroluminescent materials which can be excited independently of one another. These materials can be juxtaposed, as described in the aforementioned Articles of Brunel and King, or can be superimposed as described in the Brunel Article.

Thus, the display according to the invention benefits from all the advantages associated with the PC-EL memory effect, namely high luminance, low consumption, as well as low switched voltages and currents. The originality of the display is based on the fact that advantage is taken of this "double substrate" structure for advantageously inserting an optical filter, which gives a good chromatic purity to the EL emission of the second structure, while protecting the PC layer from emissions from the first structure, which are quasi-integrally blocked by the filter and the partly blocked ambient illumination. This leads to a reduction of the influence of the ambient illumination and the illuminated pixels of the first structure on the PC-EL hysteresis of the pixels of the second structure.

The optical filter is chosen so as to eliminate any overlap of the emission spectrum of the EL layer of the second substrate and the emission spectrum of the EL layer or layers of the first substrate. It can be a pass band, low pass or high pass filter. Moreover, it can be placed between the two structures or integrated into the first or second structure. In order to limit the influence of the first EL layer, as well as that of the ambient illumination on the photoconductive material, the latter has a sensitivity spectrum largely contained in the spectral range blocked by the filter.

The optical filter can be an interference filter. These filters make it possible to obtain low pass, high pass and band pass spectra with random cutoff wavelengths. Moreover, it has a sudden spectral transition from the conductive state to the non-conductive state, as well as a high chemical and thermal stability. However, these filters are often expensive. Moreover, when possible, use tends to be made of colored glasses or organic filters.

The organic filters are more particularly those used for liquid crystal polychromatic screens such as polymer or gelatin layers containing dyes or organic pigments, polyimide layers with dyes, vacuum-evaporated organic dyes or pigments: perylene (red), lead phthalocyanine (blue), copper phthalocyanine (green), quinacridone (magenta), isoindolinone (yellow), as well as electrodeposited pigments.

Advantageously, the first and second electroluminescent layers are respectively inserted between two insulating layers. Moreover, another insulating layer is optionally provided between the photoconductive layer and the facing electrode system.

According to the invention it is possible to use all known electrode systems for display purposes. In particular, for each structure, one of the electrode systems can be constituted by point electrodes and the other system by a common electrode. Advantageously, each of the electrode systems is constituted by parallel conductive strips, the conductive strips of the first system crossing the conductive strips of the second and the conductive strips of the third system crossing those of the fourth.

Moreover, the display according to the invention can operate in reflection or transmission.

As a function of the operating type used and the precise configuration of the electrode systems, the second and third electrode systems can be transparent, opaque or reflecting.

In order to ensure the bistability of the second PC-EL structure, it is desirable that the overlap of the emission spectrum of the second electroluminescent layer and the sensitivity spectrum of the photoconductive layer is at a maximum.

In addition, the second electroluminescent layer advantageously has a relatively wide emission spectrum, so as to cover the part of the visible spectrum not blocked for the display and a large part of the sensitivity spectrum of the photoconductive material in the part of the light spectrum filtered for the PC-EL effect.

However, the electroluminescent material or materials of the first substrate tend to have a line emission spectrum. For a respectively dichromatic and trichromatic display, said material or materials have one or two lines in the visible range not blocked by the filter.

The material for the given broadband emission spectrum can be $ZnS:Mn^{2+}$ with a relatively narrow emission band in the yellow and orange; $CaS:Eu^{2+}$ with a red color cast; $SrS:Eu^{2+}$ with a color cast between the red and orange; $CaS:Ce^{3+}$ with a color cast from green to orange; and $SrS:Ce^{3+}$ with a color cast from blue to green.

The electroluminescent material with the wide band for which the emission spectrum can be modified as a function of the optical filter and the photoconductive material used, reference can be made to $CA_xSr_{1-x}$-

S:$Eu^{2+}$ with x being between 0 and 1, the color cast for x=1 being red and for x=0 orange; $Ca_xSr_{1-x}S:Ce^{3+}$ with x between 1 and 0, x=1 corresponding to a green color cast and x=0 to a blue color cast. It is also possible to mix two luminescent material activators in a first matrix for adapting the broad emission band of the electroluminescent material. The spectrum obtained is then a combination of the elementary spectra of the two activators, examples being SrS:$Eu^{2+}$, $Ce^{3+}$; CaS:$Eu^{2+}$, $Ce^{3+}$; SrS:$Ce^{3+}$, $Pr^{3+}$.

Electroluminescent materials with several narrow bands or lines usable in the invention are ZnS:$Sm^{3+}$ with a red color cast; ZnS:$Tb^{3+}$ with a green and a green - blue color cast; ZnS:$Tm^{3+}$ with a blue and near infrared color cast (780 nm); SrS:$Pr^{3+}$ with two color casts, one in the red and the other in the blue-green. It is also possible to use alloys such as $Zn_xSr_{1-x}S:Tb^{3+}$; $Zn_xCa_{1-x}S:Tb^{3+}$; $Sr_xCa_{1-x}S:Tb^{3+}$ with x between 0 and 1.

It is possible to modify the line emission spectrum of certain electroluminescent materials by using several activators in the same matrix such as ZnS:$Sm^{3+}$,$Tb^{3+}$.

For further information on the form of the spectra of the electroluminescent materials given hereinbefore, reference can be made to the Article by Shosaku Tanaka et al, SID-88 Digest, pp. 293–296 "Bright-white-light electroluminescent devices with new phosphor thin-films based on SrS", to the Article by Hiroshi Kobayashi "Recent Development of Multi-color Thin-Film Electroluminescence Research", abstract no. 1231, pp. 1712/1713, Extended Abstracts of the Electrochemical Society Meeting, vol. 87-2, Oct. 18–23, 1987 and to the Article by Shosaku Tanaka "Color electroluminescence in alkaline-earth sulfide thin-films", Journal of Luminescence, 40 & 41, 1988, pp. 20–23.

The most widely used photoconductive materials for PC-EL structures are $CdS_xSe_{1-x}$, a-$Si_{1-x}C_x$:H with $0<x<1$, CdS, CdSe and a-Si:H. These materials have relatively narrow sensitivity spectra. Advantageously, use is made of PC materials with an adjustable sensitivity spectrum such as $CdS_xSe_{1-x}$ and a-$Si_{1-x}C_x$:H.

For further information on the production and properties of hydrogenated and carbonated amorphous silicon, reference can be made to FR-A-2 105 777 filed in the name of the present inventor.

This material is preferably deposited by plasma assisted chemical vapour phase deposition (PECVD), with a low power level of approximately 0.1 W/$cm^2$. For further details of the method for depositing a-$Si_{1-x}C_x$:H, reference can be made to the Article by M. P. Schmidt et al, Philosophical Magazine B, 1985, vol. 51, no. 6, pp. 581–589, "Influence of carbon incorporation in amorphous hydrogenated silicon".

For further information on sensitivity spectra of $CdS_xSe_{1-x}$ materials, reference can be made to the Article by Robert et al, Journal of Applied Physics, vol. 48, no. 7, July 1977, pp. 3162–3164, "II-VI solid-solution films by spray pyrolysis".

Preference is given to the use of a-$Si_{1-x}C_x$:H with $0 \leqq x \leqq 1$ and more preferably $0<x<0.5$. Thus, this photoconductive material has a certain number of advantages. In particular, it has a sensitivity drop on the side of the high wavelengths (i.e. the low energy levels) corresponding to an optical absorption drop associated with an optical forbidden band. It is pointed out that $\lambda(nm)=1240/E(eV)$.

A characteristic of the photoconductivity spectrum of this material is the energy $E_{04}$ (in eV) for which the absorption coefficient is $10^4 cm^{-1}$. This energy $E_{04}$ can be adjusted by acting on the carbon content x in the PC layer by means of the methane content in the gaseous methane - silane mixture used for the production of this photoconductive material $C=[CH_4]/[CH_4+SiH_4]$.

On the side of the short wavelengths (high energy levels), the sensitivity of the photoconductive material also drops, because the radiation is absorbed in all the first films of the photoconductive layer and the photoconduction, sought in the direction normal to the plane of the layers (transverse electrical excitation) is prevented, because the photoconductive material core is not exposed to the exciting radiation.

The resultant photosensitivity spectrum of a-$Si_{1-x}C_x$ for a layer with a thickness of 1 micrometer is a wide peak, whose mid-height width is approximately 50 nanometers and whose maximum is at $E_{04}$. The mid-height width corresponds to the distance separating the high and low cutoff thresholds of the PC material.

BRIEF DESCRIPTION OF THE DRAWINGS

Other characteristics and advantages of the invention can be gathered from the following non-limitative description with reference to FIGS. 3 to 9, FIGS. 1 and 2 having been already described.

DETAILED DESCRIPTION OF THE PREFERRED EMBODIMENT

Figure 3:
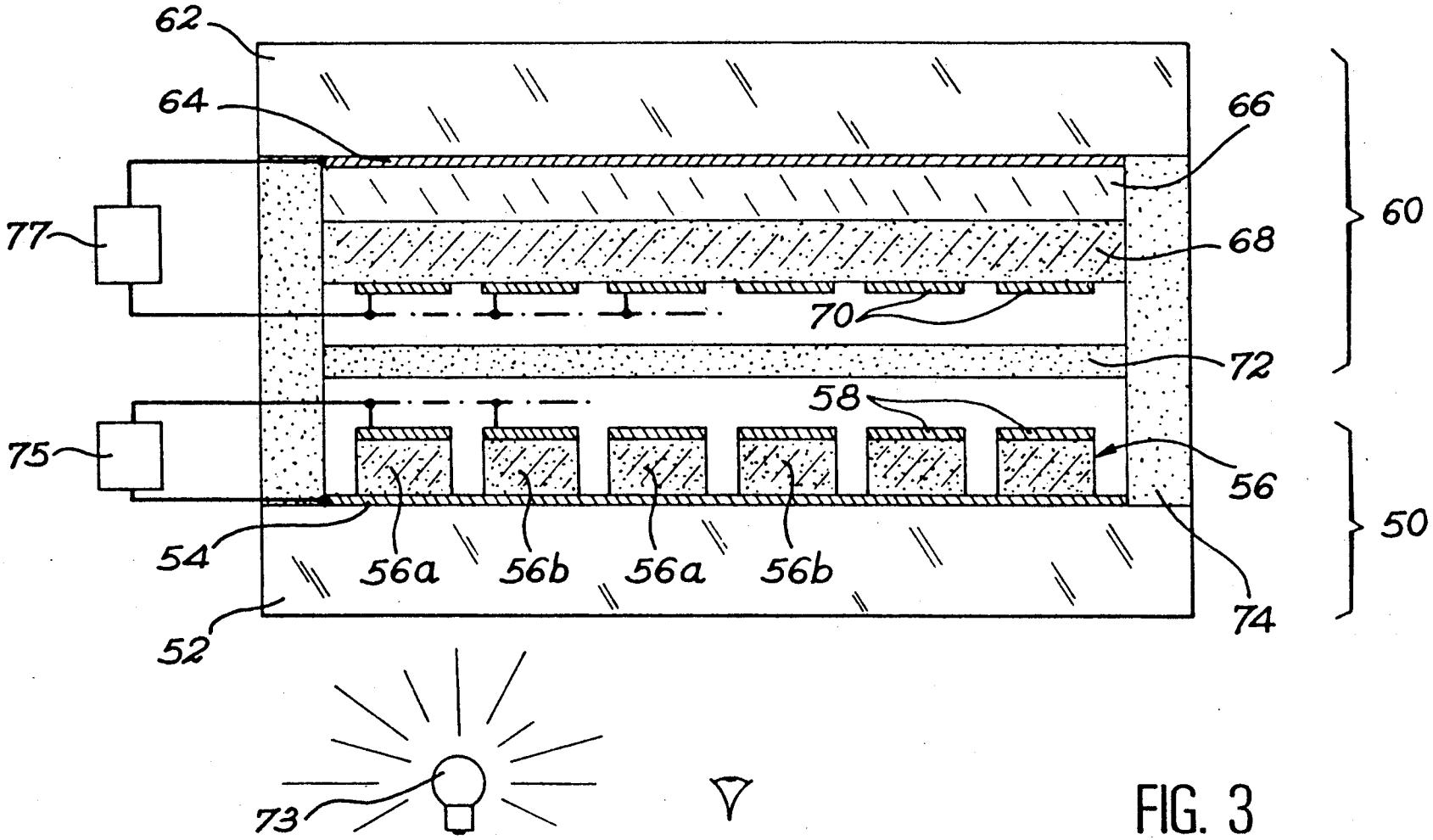
FIG. 3 diagrammatically shows an embodiment of the display according to the invention.

In FIG. 3, the display according to the invention has a first structure 50 with a generally glass, transparent insulating substrate 52 constituting one of the faces of the display. On its inner face, substrate 52 is provided with a first system of electrodes constituted by parallel conductive strips 54 and made from a transparent material such as ITO.

Figure 7:
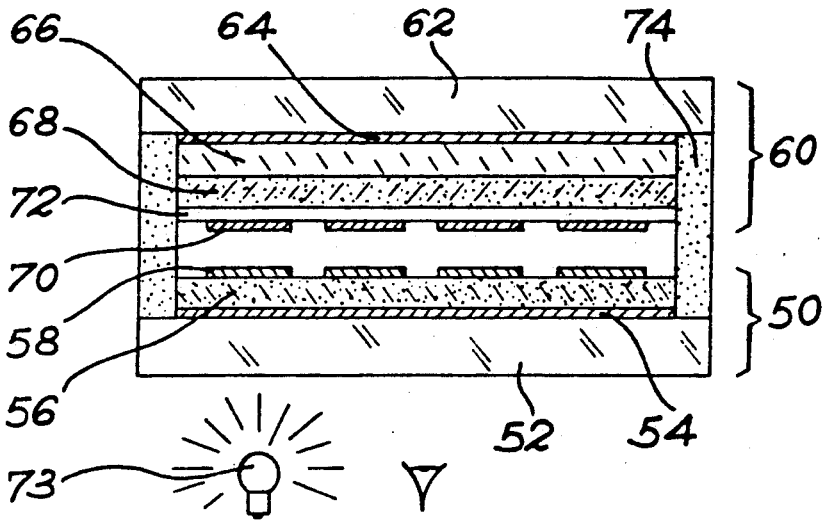
FIGS. 7 to 9. Constructional variant of the display according to the invention.
Figure 8:
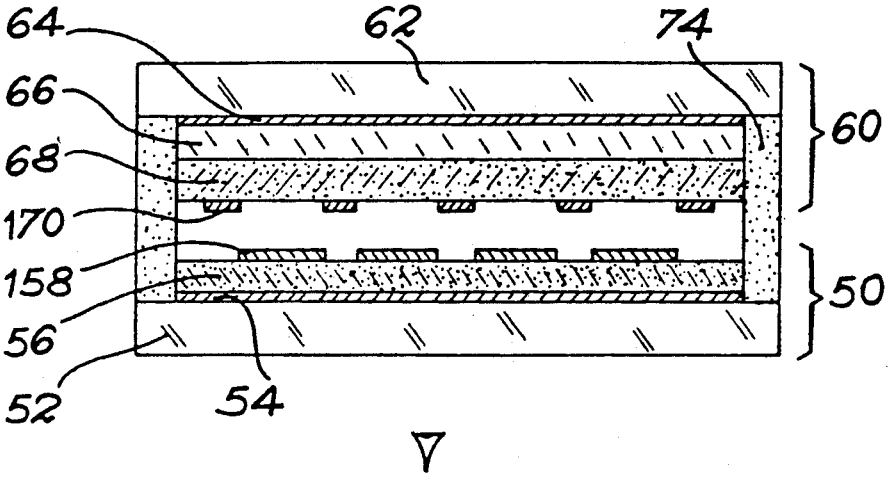
Figure 9:
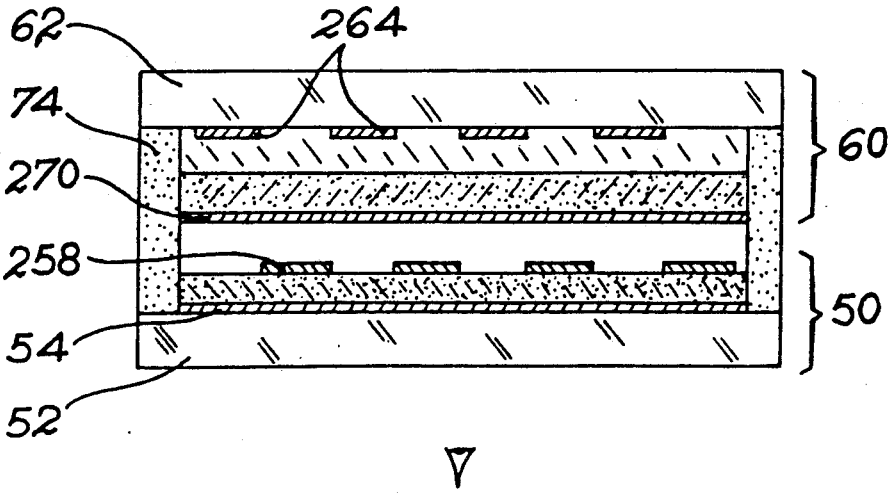

Electrodes 54 carry a first electroluminescent layer 56 covering the entire display surface and formed from two different monochromatic El materials **56*a* and 56*b* juxtaposed in order to ensure a trichromatic display. Materials 56*a* and 56*b* are chosen from among the aforementioned line materials El and have a thickness between 0.5 and 2 micrometers and typically 700 nm. Use is made of a single electroluminescent material for a dichromatic display (FIGS. 7 to 9**).

This El layer 56 carries a second system of electrodes constituted by parallel conductive strips 58. These electrodes 58 are positioned perpendicular to the electrodes 54 and are made from a transparent material, more particularly ITO.

Figure 1:
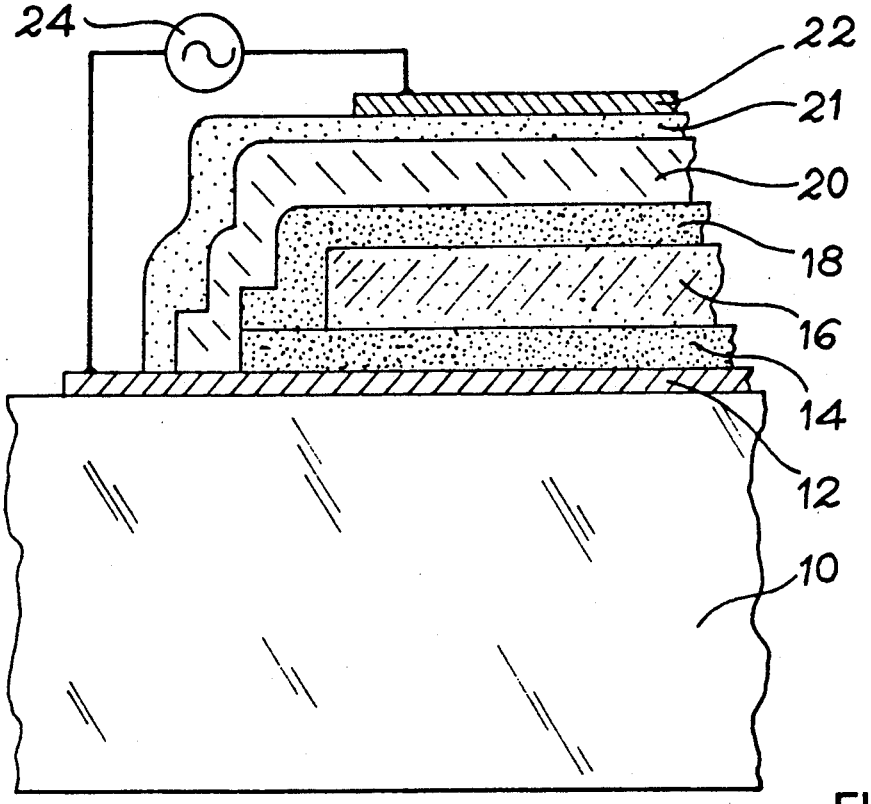
Figure 2:
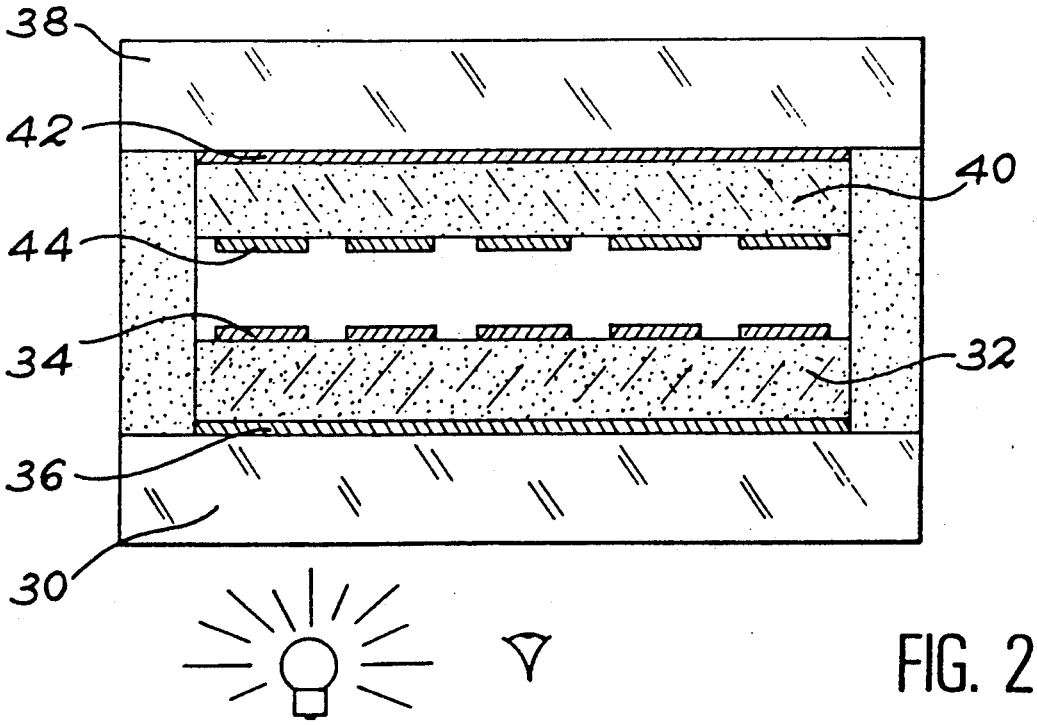

Materials **56*a* and 56*b* are in the form of strips parallel to the conductive strips 58 and defined by etching according to the so-called "phosphor patterning" method, strips 56*a* alternating with strips 56*b*. They can be used in the manner shown in FIG. 3 or can be associated with one or more dielectric layers as shown in FIG. 1 or FR-A-2 574 972. In other words, layer 56 is sandwiched between two dielectric layers 14, 18**.

Associated with the first structure 50 is a second, so-called inverted structure 60 having an optionally transparent and in particular glass insulating substrate 62 constituting the second face of the display. This second structure 60 has an electrode system constituted by parallel conductive strips 64 and called the third electrode system. These conductive strips 64 are generally reflecting and made from aluminum. These electrodes 64 are located on a photoconductive layer 66 of a-$Si_{1-x}C_x$:H with $0 \leqq x \leqq 1$, having a thickness of 1 micrometer and covering an electroluminescent structure constituted by a single emitting layer 68, as shown in FIG. 3, or associated with one or more dielectric layers: a dielectric layer 14 between layer 68 and electrode 70, a dielectric layer 18 between layer 68 and PC layer 66 and optionally a dielectric layer 21 between the PC layer and electrodes 64. The electroluminescent structure 68 and the photoconductive layer 66 cover the entire display surface.

The electroluminescent material of layer 68 has a wide emission spectrum, like one of those referred to hereinbefore and its thickness is between 0.5 and 2 micrometers, typically 700 nm. The dielectric layers 14, 18, 21 optionally associated with the El materials can be made from one of the materials chosen from among $Si_3N_4$, $SiO_2$, $SiO_xN_y$, $Ta_2O_5$ and can have a thickness of 200 nm.

With a view to the simplification of the drawings and the corresponding description, the remainder of the text will only refer to the use of electroluminescent layers 56, 68, although they are preferably inserted between two insulating layers.

Beneath the electroluminescent layer 68 is located a so-called fourth system of electrodes constituted by parallel conductive strips 70 and made from a transparent material, e.g. ITO, the electrodes 70 being positioned perpendicular to the electrodes 64.

In this embodiment, the electrodes 54 and 64 are parallel and coincide. In the same way, electrodes 58 and 70 are parallel and coincide.

According to the invention, an optical filter 72 is positioned between the observer and the second electroluminescent layer 68. In the embodiment of FIG. 3, the optical filter 72 is placed between the two structures 50 and 60, but could also be integrated into the structure 60, as will be shown hereinafter, or with the structure 50. Filter 72 permits an effective filtering of the light produced by the first El layer 56 and the light intensity of the ambient illumination (e.g. lamp 73).

A peripheral insulating spacer 74 ensures the cohesion of the complete display. This structure 50 and 60 of the display according to the invention operates in the same way as the polychromatic displays of the prior art and in particular by using peripheral control circuits 75 and 77 of the type used in flat liquid crystal screens. These circuits 75, 77 supply appropriate alternative or alternating signals and are connected to the electrodes respectively 54–58 and 64–70. The peak amplitude 0 is 150 to 300 V (typically 230 V).

The principle of the electrical control of the two-substrate display according to the invention is the same as all the prior art displays.

In a first method shown in FIG. 3, the two matrix structures are controlled independently of one another, each then being considered as a conventional, autonomous El matrix screen with its own control electronics. However, it has to be pointed out that if the first structure is of a conventional nature, the second structure is a memory effect PC-El screen, whose control method, of a slightly special nature, is e.g. described in FR-A-2 615 644 of C. Brunel and P. Thioulouse. For example, the oscillating frequency of the control signals is 1 kHz.

When the electrode networks 58 and 70 are parallel, as in FIG. 3, it is possible to use a second method consisting of connecting each electrode 58 to an electrode 70 (in facing manner or as close as possible) by at least one end, use then being made of a control circuit common to the two electrodes 58 and 70.

Figure 4:
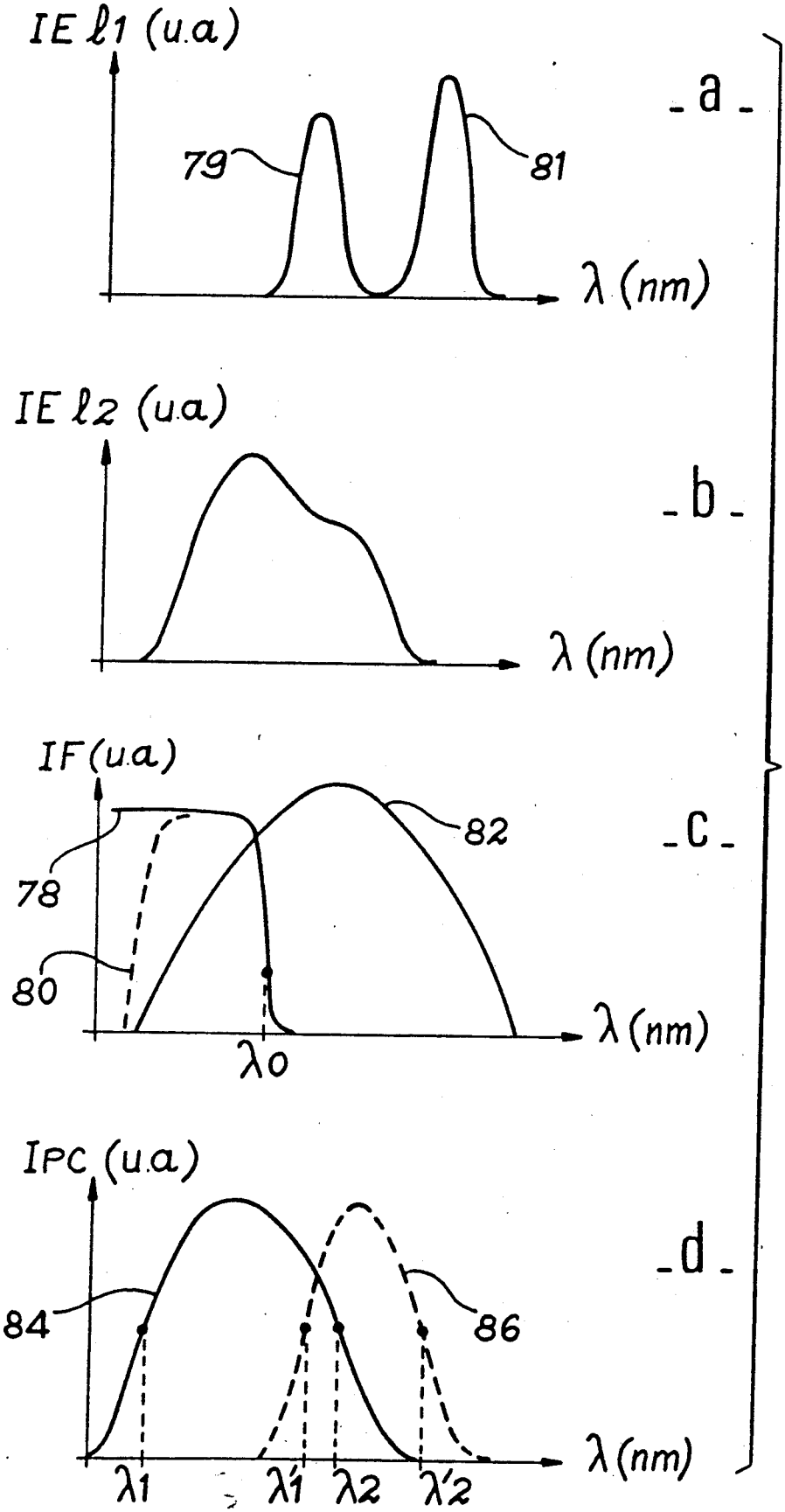
FIGS. 4 to 6 give the configuration of the sensitivity ($I_{PC}$) and emission ($I_{El}$) spectra required respectively of the photoconductive and electroluminescent layers, as well as the transmission spectrum of the optical filter of the display of FIG. 3.

Part a of FIG. 4 shows the emission spectrum of the first electroluminescent layer $El_1$. Layer $El_1$ is formed from two different monochromatic materials of the line type for a trichromatic display. Part b of FIG. 4 shows the emission spectrum of the electroluminescent material $El_2$ of the second structure 60, the material being of the wide band type. Part c of FIG. 4 shows the transmission spectrum of the optical filter F and that of the ambient illumination. Curve 78 corresponds to a low pass filter and curve 80 to a band pass filter. Part d shows the sensitivity spectrum of the photoconductive material PC. These spectra give the variations of the light intensity I in arbitrary units and as a function of the wavelength in nanometers.

According to the invention, the filtered emission spectrum of the material $El_2$ is complementary of that of layer $El_1$, i.e. these two spectra have a minimum overlap zone. In the represented case, the layer $El_1$ for a trichromatic display has electroluminescent materials respectively corresponding to the two lines 79 and 80. According to the invention, line 89 is located outside the emission spectrum of the material $El_2$. For a dichromatic display, the layer $El_1$ would only have a single material and therefore only a single line (in particular line 81).

According to the invention, the low pass filter 78 or band pass filter 80 has a cutoff wavelength $\lambda_0$ above which the emission of the material $El_2$ and the ambient light are blocked and below which the emission $El_2$ and the ambient light represented by spectrum 82 are transmitted. $\lambda_0$ corresponds to 1/10 of the transmitted light. Moreover, the low pass filter 78 or band pass filter 80 blocks the entire emission spectrum of layer $El_1$. In other words, $\lambda_0$ is equal to or below the cutoff wavelength of the lowest wavelength line 79 of layer $El_1$. Furthermore, according to the invention, the transmission spectrum of the filter is essentially contained in the useful emission spectrum of the material $El_2$, in order to give a high color purity.

FIG. 4*d* shows two possible sensitivity spectra of the photoconductive material 84 and 86. A low cutoff wavelength $\lambda_1$ and a high cutoff wavelength $\lambda_2$ corresponds to spectrum 84 and a low cutoff wavelength $\lambda_1$, and a high cutoff wavelength $\lambda_2$, correspond to spectrum 86. These cutoff wavelengths are taken for a mid-height sensitivity of the sensitivity spectrum. $\lambda_{04}$ and $\lambda_{04'}$ correspond to the maximum sensitivity wavelength.

These two sensitivity spectra 84, 86 of material PC are essentially contained in the emission spectrum (FIG. 4*b*) of the material $El_2$ and are essentially located outside the emission spectrum of the material $El_1$ (FIG. 4*a*).

For a maximum overlap of the emission spectrum of material $El_2$ (FIG. 4*b*) and the sensitivity spectrum of material PC with a view to a maximum PC-El effect, use is made of a material PC with a wide sensitivity spectrum corresponding to spectrum 84 for which $\lambda_1$ is below $\lambda_1$ and $\lambda_2$ is equal to or above $\lambda_0$.

For a maximum protection of the PC material relative to ambient illumination, use is made of a PC material with a narrower spectrum than in the preceding case corresponding to spectrum 86 for which the wavelength $\lambda_1$, is equal to or higher than $\lambda_0$. The sensitivity spectrum of the PC material is thus totally within the zone blocked by filter 78 or 80.

After filtering, the ambient illumination (spectrum 82) is outside the sensitivity spectrum 86 of the PC material and consequently does not affect the hysteresis of the PC-El effect.

Figure 5:
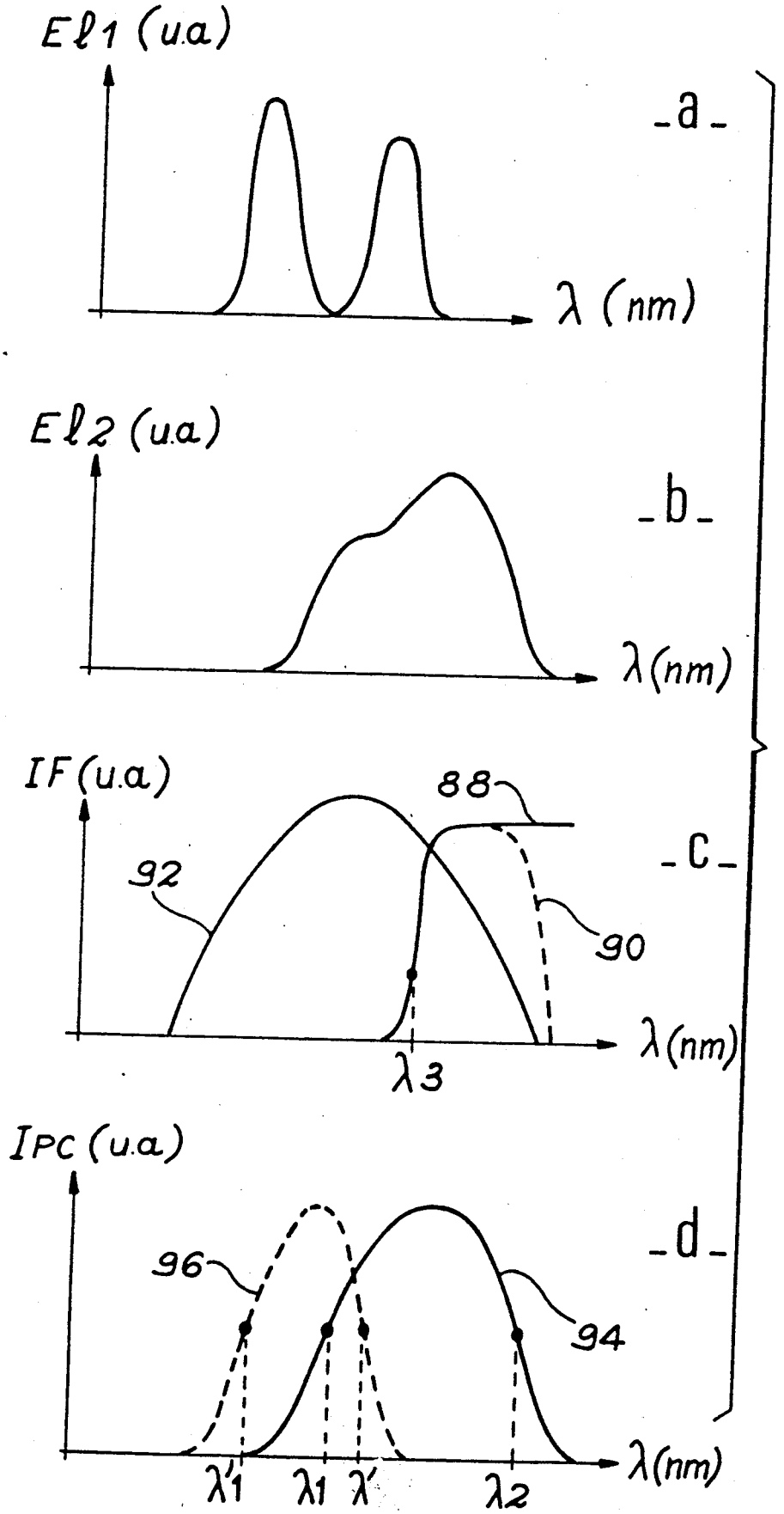

FIG. 5 shows the different light intensity spectra required of the filter, the photoconductive material and the electroluminescent materials $El_1$ and $El_2$ when using a high pass or band pass filter with a cutoff wavelength $\lambda_3$ towards the high wavelengths. The principle is similar to that illustrated in FIG. 4. These intensities are given in arbitrary units as a function of the wavelengths in nanometers.

In FIG. 5, part a represents the emission spectrum of the material $El_1$ (structure 50) of the line type. Part b gives the wide band emission spectrum $El_2$ of the material (structure 60). Part c gives the transmission spectrum of the optical filter f (curves 88, 90) and that of the ambient illumination (curve 90). Curve 88 corresponds to a high pass filter and curve 90 to a band pass filter. Finally, part d of FIG. 5 shows the two possible sensitivity spectra of the PC material.

In this embodiment, the ambient light (curve 90) and the emission of the material $El_2$ (FIG. 5*a*) located in wavelengths below the cutoff wavelength $\lambda_3$ of the filter are blocked, whereas those above $\lambda_3$ are transmitted. Moreover, the transmission spectrum of the filter is totally outside the emission spectrum of material $El_1$ and largely in the spectrum $El_2$.

In FIG. 5*d*, the two sensitivity spectra 96 and 94 of the photoconductive material are essentially contained in the emission spectrum of material $El_2$ in order to ensure the PC-El effect.

As hereinbefore, use is made of a PC material with the spectrum 94 for a maximum overlap of the spectrum with the emission spectrum of the material $El_2$. In this case, we have $\lambda_1 \leqq \lambda_3 \leqq \lambda_2$. For a maximum protection of the PC material relative to ambient illumination, use is made of a PC material with the spectrum 96 for which $\lambda'_2$ is equal to or below $\lambda_3$, $\lambda_1$, $\lambda'_1$, $\lambda_2$, $\lambda'_2$ have the same meanings as hereinbefore (FIG. 4*d*).

Figure 6:
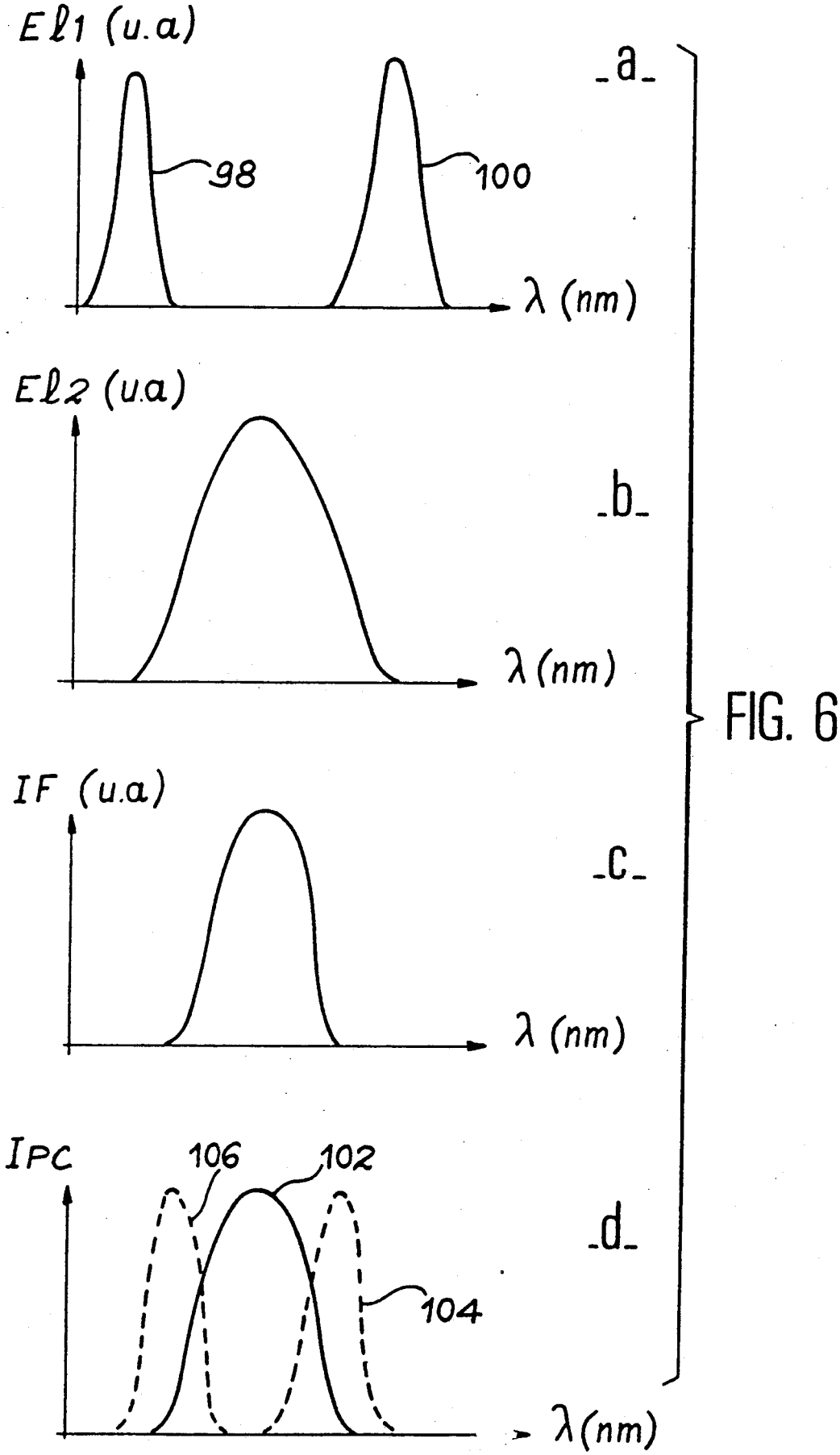

FIG. 6 shows another possible solution for the different light intensity spectra for materials $El_1$, $El_2$, PC and the filter. Parts a and b of FIG. 6 respectively give the emission spectra of materials $El_1$ and $El_2$. Part c gives the transmission spectrum of the filter and part d the different possible sensitivity spectra for the material PC.

In this embodiment, the two emission lines of the material $El_1$ are on either side of the emission spectrum of material $El_1$. Line 98 is located in the wavelength range below those of spectrum $El_2$ and line 100 is located in the wavelength range above those of spectrum $El_2$. The transmission spectrum of the filter (FIG. 6*c*) is entirely contained within the emission spectrum of the material $El_2$.

The material PC either has the sensitivity spectrum 102 entirely located in the transmission spectrum of the filter in order to assist the PC-El effect, or the spectrum 104 or 106 for a maximum protection of the PC material relative to ambient illumination.

The different layers constituting the display according to the invention can be arranged in different ways, as can be gathered from FIGS. 7 to 9. In particular, the optical filter 72 can be integrated into the PC-El structure 60. For example, it can be inserted between electrodes 70 and the electroluminescent layer 68, as shown in FIG. 7.

In the case of a complex electroluminescent structure with several dielectric layers (FIG. 1), the optical filter can constitute one of these dielectric layers, or can be inserted between one of the dielectric layers and the electroluminescent layer. As shown in FIGS. 8 and 9, it is also possible to modify the configuration of the electrodes.

In the embodiment of FIG. 8, the front electrodes 158 and 170 of each of the two structures no longer coincide as in FIG. 3, but are instead displaced and in particular arranged in alternating manner. It is therefore possible to use electrodes 158 which instead of being transparent are reflecting and in particular are made from aluminum.

This arrangement offers the advantage of a higher luminance than that of the display of FIG. 3. Moreover, it is no longer possible for any emission of the first El layer 56 to reach and disturb the photoconductive layer 66 of structure 60. Moreover, the use of an optical filter in this embodiment is no longer necessary.

Moreover, in view of the high punctiform luminance as a result of the PC-El effect, it is possible to reduce the size of the image points of the second structure 60. Typically, the width of an electrode 170 can be reduced to less than 100 micrometers instead of 300 micrometers. It is then no longer necessary to have a large spacing between the electrodes 158 in order to permit the transmission of the emission of layer 66.

In the embodiment of FIG. 9, the rear electrodes 264 of structure 60, in contact with the substrate, are parallel to the front electrodes 258 of structure 50. Consequently, the front electrodes 270 of structure 60 are parallel to the rear electrodes 254 of structure 50.

In addition, the electrodes 264 and 258 are displaced or arranged in alternating manner, which makes it possible to choose a reflecting material, i.e. which is a very good conductor for the electrodes 258. Thus, as in the embodiment of FIG. 8, it is possible to reduce the width of the electrodes 264 and therefore the pixels. The reduction of the size of the pixels makes it possible to reduce the spacing between the electrodes 258 and/or to increase the definition of the images obtained on the display.

Hereinafter are given embodiments of the display according to the invention, in which the electroluminescent material is $a\text{-}Si_{1-x}C_x{:}H$ with $0 \leqq x \leqq 1$.

EXAMPLE 1

This example is illustrated by FIG. 4:

a) First structure 50:
   electroluminescent material: $ZnS{:}Tb^{3+}$—green emitter.

b) Second structure 60:
   electroluminescent material: $SrS{:}Ce^{3+}$—blue emitter.
   Oriel low pass interference filter of cutoff wavelength $\lambda_0 = 500$ nm.
   photoconductive material of $\lambda_{04}$ close to 500 nm, so that $E_{04}$ is close to 2.48 eV; $C = 0.80$ and $x = 0.20$. This material corresponds to the sensitivity spectrum 84 in FIG. 4*d*.

EXAMPLE 2

This example differs from example 1 through the use of a photoconductive material having a spectrum 86 (FIG. 4*d*). This material has $\lambda'_1=500$ nm, $\lambda_{04}=525$ nm and therefore $E_{04}=2.36$ eV; C=0.70 and x=0.14.

EXAMPLES 3 to 5

These examples differ from examples 1 and 2 through the use of an electroluminescent material $El_1$ of structure 50 emitting in the red instead of the green.

Example 3: $ZnS:Sm^{3+}$

Example 4: $SrS:Eu^{2+}$

Example 5: $Cas:Eu^{2+}$.

These electroluminescent materials can be associated with the PC material of example 1 or that of example 2.

Examples 1 to 5 lead to dichromatic displays.

EXAMPLES 6 to 8

For a trichromatic display it is merely necessary to associate in the first structure 50 and with the electroluminescent material of example 1 emitting in the green, one of the electroluminescent materials of examples 3 to 5 emitting in the red. This association is in fact a juxtapositioning of electroluminescent materials, as described in the aforementioned article by C. Brunel and as shown in FIG. 3.

EXAMPLES 9 and 10

For a Trichromatic Display

These examples are illustrated by FIG. 5.

a) First structure 50: two juxtaposed electroluminescent materials, as in the article by C. Brunel, namely $ZnS:Tb^{3+}$—green emitter and $ZnS:Tm^{3+}$ (example 9) or $SrS:Ce^{3+}$ (example 10)—blue emitter.

b) Second structure 60:

electroluminescent material: $SrS:Eu^{2+}$—red emitter and Oriel high pass interference filter with $\lambda_3=600$ nm.

photoconductive material with a sensitivity spectrum 94 (FIG. 5*d*): $\lambda_{04}=610$ nm; $E_{04}=2.03$ eV; C=0.33 and x=0.037.

EXAMPLES 11 and 12

Trichromatic Display

These examples differ from examples 9 and 10 through the use of $ZnS:Sm^{3+}$ as the red emitter in the second structure 60.

EXAMPLES 13 to 16

Trichromatic Display

These examples differ from examples 9 to 12 by the use of a photoconductive material with a sensitivity spectrum 86 (FIG. 4*d*): $\lambda_2=600$ nm; $\lambda_{04}=575$ mn; $E_{04}=2.15$ eV; C=0.50 and x=0.07.

EXAMPLES 17 and 18

Trichromatic Display

These examples are illustrated by FIG. 6.

a) First structure 60: two juxtaposed electroluminescent materials, namely $CaS:Eu^{2+}$—red emitter, $SrS:Ce^{3+}$ (example 17) or $ZnS:Tm^{3+}$ (example 18)—blue emitter.

b) Second structure 50:

electroluminescent material: $ZnS:Tb^{3+}$—green emitter.

Oriel band pass interference filter with a low cutoff wavelength $\lambda_3=510$ nm and a high cutoff wavelength $\lambda_0=575$ nm.

photoconductive material with a sensitivity spectrum 102 (FIG. 6*d*): $\lambda_{04}=550$ nm; $E_{04}=2.25$ eV; C=0.61 and x=0.10.

EXAMPLES 19 and 20

Trichromatic Display

These examples differ from examples 17 and 18 by the use of a photoconductive material with the spectrum 106 (FIG. 6*d*): $\lambda_2=510$ nm; $\lambda_{04}=485$ nm; $E_{04}=2.56$ eV; C=0.83 and x=0.21.

EXAMPLES 21 and 22

These examples differ from examples 17 and 18 by the use of a PC material with spectrum 104 (FIG. 6*d*): $\lambda_1=575$ nm; $\lambda_{04}=600$ nm; $E_{04}=2.07$ eV; C=0.40 and x=0.04.

EXAMPLES 23 to 28

Trichromatic Display

In examples 17 to 22 it is possible to replace the green emitter $ZnS:Tb^{3+}$ by $CaS:Ce^{3+}$.

I claim:

1. A polychromatic display, comprising: a first structure having a first transparent substrate equipped with a first electroluminescent layer placed between a first system of transparent electrodes and a second system of electrodes, said first and second systems of electrodes connected to a first electrical means permitting the excitation of certain zones of the first electroluminescent layer, a second structure having a second substrate equipped with a second electroluminescent layer and a photoconductive layer stacked on one another and covering the entire display surface, said second electroluminescent layer being placed in direct contact with said photoconductive layer for obtaining a PC-EL effect, said photoconductive and second electroluminescent layers being placed between a third system of transparent electrodes and a fourth system of transparent electrodes, said third and fourth systems of electrodes being connected to a second electrical means for effecting the excitation of certain zones of the second electroluminescent layer, said first and second substrates constituting opposite faces of the display, and and wherein the first electroluminescent layer has a monochromatic or dichromatic emission spectrum, and the second electroluminescent layer has an essentially monochromatic emission spectrum and a chromatic component complementary of the emission color or colors of the first electroluminescent layer.

2. A polychromatic display according to claim 1, wherein the first electroluminescent layer is dichromatic and comprises two different monochromatic electroluminescent materials.

3. A polychromatic display according to claim 1, further comprising an optical filter for totally or almost totally blocking the emission spectrum of the first electroluminescent layer.

4. A polychromatic display according to claim 3, wherein the sensitivity spectrum of the photoconductive layer is contained in that part of the spectrum that is blocked by the filter.

5. A polychromatic display according to claim 3, wherein the second electroluminescent layer has a broad band spectrum that is partially blocked by the optical filter.

6. A polychromatic display according to claim 3, wherein the filter is located between the first and second structures.

7. A polychromatic display according to claim 3, wherein the filter is integrated into the second structure.

8. A polychromatic display according to claim 1, wherein the second electroluminescent layer is placed between a first and second dielectric layers, the first dielectric layer being in contact with the photoconductive layer.

9. A polychromatic display according to claim 1, further comprising a dielectric layer located between the photoconductive layer and the third electrode system.

10. A polychromatic display according to claim 1, wherein the first electroluminescent layer is inserted between two dielectric layers.

11. A polychromatic display according to claim 1, wherein the electrode systems are each constituted by parallel conductive strips, the conductive strips of the first and second systems intersecting and the conductive strips of the third and fourth systems intersecting.

12. A polychromatic display according to claim 11, wherein the conductive strips of the first electrode system are positioned parallel and coinciding with the conductive strips of the third electrode system, the first and third electrode systems being respectively in contact with the first and second substrates and in that the conductive strips of the second electrode system are arranged parallel and coinciding with the conductive strips of the fourth electrode system, the conductive strips of the second electrode system being transparent.

13. A polychromatic display according to claim 11, wherein the conductive strips of the first electrode system are parallel and coincide with the conductive strips of the fourth electrode system, the first and third electrode systems being respectively in contact with the first and second substrates and the conductive strips of the second electrode system are parallel to the conductive strips of the third electrode system and in a displaced manner, the conductive strips of the second electrode system being reflecting.

14. A polychromatic display according to claim 11, wherein the conductive strips of the first electrode system are parallel and coincide with the conductive strips of the third electrode system, the first and third electrode systems being respectively in contact with the first and second electrode system and arranged parallel to the conductive strips of the fourth electrode system and displaced with respect thereto, the conductive strips of the second electrode system being reflecting.

15. A polychromatic display according to claim 1, wherein the third electrode system is reflecting.

16. A polychromatic display according to claim 1, wherein the photoconductive layer comprises hydrogenated and carbonated amorphous silicon of formula $a\text{-}Si_{1-x}C_x{:}H$ with $0<x<1$.

17. A polychromatic display according to claim 13, wherein the conductive strips of the third electrode system are narrower than the conductive strips of the second electrode system.

18. A polychromatic display according to claim 14, wherein the conductive strips of the fourth electrode system are narrower than the conductive strips of the second electrode system.

19. A polychromatic display according to claim 3, wherein the second electroluminescent layer has a broad band emission spectrum and the photoconductive layer has a sensitivity spectrum such that the overlap of the emission spectrum of the second electroluminescent layer with the sensitivity spectrum of the photoconductive layer is at a maximum.

* * * * *